US010787815B2

(12) United States Patent
Jang

(10) Patent No.: US 10,787,815 B2
(45) Date of Patent: Sep. 29, 2020

(54) VENTILATING AND HEAT DISSIPATING ASSEMBLY FOR A ROOF

(71) Applicant: Kuan-Chih Jang, Kaohsiung (TW)

(72) Inventor: Kuan-Chih Jang, Kaohsiung (TW)

( * ) Notice: Subject to any disclaimer, the term of this patent is extended or adjusted under 35 U.S.C. 154(b) by 28 days.

(21) Appl. No.: 16/554,837

(22) Filed: Aug. 29, 2019

(65) Prior Publication Data

US 2020/0190809 A1 Jun. 18, 2020

(30) Foreign Application Priority Data

Dec. 18, 2018 (TW) ..... 107145718 A

(51) Int. Cl.
*E04D 13/17* (2006.01)
*E04D 13/16* (2006.01)
*F24F 7/02* (2006.01)

(52) U.S. Cl.
CPC ..... *E04D 13/17* (2013.01); *E04D 13/1681* (2013.01); *E04D 13/1687* (2013.01); *F24F 7/02* (2013.01)

(58) Field of Classification Search
CPC . E04D 13/17; E04D 13/1687; E04D 13/1681; F24F 7/02
See application file for complete search history.

(56) References Cited

U.S. PATENT DOCUMENTS 1,451,340 A * 4/1923 Kroonen ..... E04B 2/42 52/429
1,481,249 A * 1/1924 Beinecke ..... E04B 2/42 52/505
1,720,306 A * 7/1929 Tremper ..... E04B 2/20 138/115
2,198,688 A * 4/1940 Williamson ..... E04B 2/42 138/115
2,199,946 A * 5/1940 Barnhart ..... E04C 1/41 52/310
2,451,392 A * 10/1948 Kennedy ..... C21B 9/06 165/9.1
2,552,712 A * 5/1951 Ellis ..... E04B 2/14 52/274

(Continued)

FOREIGN PATENT DOCUMENTS

ES 2364168 A1 8/2011
GB 2181470 A * 4/1987 ..... E04D 13/17

(Continued)

OTHER PUBLICATIONS

Search Report appended to an Office Action, which was issued to Taiwanese counterpart application No. 107145718 by the TIPO dated Nov. 21, 2019, with an English translation thereof.

*Primary Examiner* — Rodney Mintz
(74) *Attorney, Agent, or Firm* — Akerman LLP; Peter A. Chiabotti

(57) ABSTRACT

A ventilating and heat dissipating assembly for a roof includes hollow bricks, first corrugated plates and second corrugate plates. Each first corrugated plate spans a gap between two pairs of the hollow bricks that are spaced apart along intersecting first and second directions. Each second corrugated plate spans a gap formed between two of the hollow bricks spaced apart in the first direction and a gap between two of the first corrugated plates spaced apart in the second direction.

10 Claims, 18 Drawing Sheets

(56) References Cited

U.S. PATENT DOCUMENTS 3,220,715 A * 11/1965 Kinney ..... C21B 9/06 165/9.4
3,461,631 A * 8/1969 Brugnola ..... E04B 2/18 52/606
4,058,948 A * 11/1977 Warren ..... E04C 1/41 52/405.1
4,251,967 A 2/1981 Hoofe, III
4,601,150 A * 7/1986 Dougherty ..... E04B 7/22 404/18
4,674,249 A * 6/1987 Bennett, Jr. ..... E04B 7/00 108/901
4,698,949 A * 10/1987 Dietrich ..... E04B 2/44 52/415
6,280,121 B1 * 8/2001 Khamis ..... E02D 29/0225 405/284
6,491,579 B1 * 12/2002 O'Hagin ..... E04D 1/30 454/250
7,775,747 B2 * 8/2010 Bott ..... E02D 29/025 405/284
8,046,969 B2 * 11/2011 Dagher ..... E04B 7/20 52/302.3
8,132,988 B2 * 3/2012 Dawson ..... B28B 7/241 405/286
8,141,313 B2 * 3/2012 Dagher ..... E04B 7/20 52/302.3
8,356,450 B2 * 1/2013 Larimore ..... E04F 15/022 52/302.1
8,453,399 B2 * 6/2013 Anderson ..... E04F 17/00 52/220.2
8,898,978 B2 * 12/2014 Murray ..... E04D 12/004 52/302.1
2003/0126806 A1 * 7/2003 Ellis ..... E04D 13/17 52/95
2005/0000172 A1 * 1/2005 Anderson ..... E04D 12/004 52/198
2006/0150559 A1 * 7/2006 Haener ..... E04B 2/46 52/606
2008/0010933 A1 * 1/2008 Faulkner ..... E04D 1/34 52/411
2009/0090083 A1 * 4/2009 Dagher ..... E04D 13/17 52/741.1
2010/0186305 A1 * 7/2010 Larimore ..... E04F 15/022 52/1
2011/0072746 A1 * 3/2011 Dagher ..... E04C 2/12 52/302.1
2011/0265407 A1 * 11/2011 Bryson ..... E04D 1/20 52/302.1
2014/0090320 A1 * 4/2014 Murray ..... E04D 1/34 52/302.1
2015/0096248 A1 * 4/2015 Tebo ..... E04F 13/0866 52/302.3
2015/0368901 A1 * 12/2015 Weber ..... E04F 19/00 52/220.2

FOREIGN PATENT DOCUMENTS

GB 2395209 A * 5/2004 ..... A01K 1/0058
TW M577038 U * 4/2014
WO 8808063 A1 10/1988
WO 9831894 A1 7/1998

* cited by examiner

VENTILATING AND HEAT DISSIPATING ASSEMBLY FOR A ROOF

CROSS-REFERENCE TO RELATED APPLICATION

This application claims priority to Taiwanese Patent Application No. 107145718, filed on Dec. 18, 2018.

FIELD

The disclosure relates to a ventilating and heat dissipating assembly, and more particularly to a ventilating and heat dissipating assembly for a roof.

BACKGROUND

Because the roof of a building is a major part which absorbs solar irradiation, if the ventilation and heat dissipation effects of the roof are insufficient, the roof can absorb considerable heat to increase indoor temperature and make indoors unpleasantly hot and stuffy. In order to dissipate heat, a modular ventilation structure is usually used to form ventilation channels, and particular heat insulation materials are used to reduce heat absorbed by the roof as much as possible.

However, the modular ventilation structure requires a lengthy time for assembly of a plurality of parts, and difficulties in assembly of the parts can adversely affect the quality of the modular ventilation structure. Further, using merely a single heat insulation material may limit variation of structural designs. The prior art is in need of a breakthrough, which not only reduces the number of modular parts for installation simplicity, but also provides sufficient ventilation channels for efficient ventilation and heat dissipation.

SUMMARY

Therefore, an object of the disclosure is to provide a ventilating and heat dissipating assembly that is suitable for a roof and that can alleviate at least one of the drawbacks of the prior art.

According to the disclosure, a ventilation and heat dissipating assembly for a roof includes a plurality of spaced apart hollow bricks, a plurality of first corrugated plates and a plurality of second corrugated plates.

The hollow bricks are arranged in intersecting rows that extend along a first direction and a second direction intersecting the first direction. Each of the hollow bricks includes a bottom wall, two side walls, a plurality of intermediate walls, a top wall, a plurality of ventilation holes, two outer holding ribs and a plurality of inner holding ribs. The bottom wall has two opposite transverse sides and two opposite longitudinal sides connected between the transverse sides. The side walls respectively and upwardly project from the two opposite transverse sides of the bottom wall. The intermediate walls project upwardly from the bottom wall between the side walls and are spaced apart along a direction parallel with the longitudinal sides of the bottom wall. The top wall is opposite to the bottom wall and disposed on top of the side walls and the intermediate walls. The ventilation holes are bounded by the bottom wall, the side walls, the intermediate walls and the top wall. Each of the ventilation holes has two ventilation open ends opposite to each other along a line parallel with the transverse sides of the bottom wall. The outer holding ribs project respectively from outer surfaces of the side walls in opposite outward directions. Each of the inner holding ribs projects from one of the intermediate walls into one of the ventilation holes.

The first corrugated plates are connected to each other and aligned along the first direction. Each of the first corrugated plates spans a gap between two pairs of the hollow bricks that are spaced apart in the first and second directions. Each of the first corrugated plates has a crest portion, a first trough portion, a second trough portion and two curved rise portions. The crest portion is elongated along and curved around a crest axial line (L) parallel with the first direction. The crest portion has two opposite lateral sides on two opposite sides of the crest axial line. The first trough portion is connected to one of the two opposite lateral sides of the crest portion. The first trough portion is seated on one of the outer holding ribs of one of two adjacent ones of the hollow bricks that are spaced apart in the second direction. The second trough portion is connected to the other one of the two opposite lateral sides of the crest portion. The second trough portion is seated on one of the outer holding ribs of the other one of the two adjacent ones of the hollow bricks that are spaced apart in the second direction. The curved rise portions are respectively connected to the first and second trough portions oppositely of the crest portion and are curved in the same direction as the crest portion.

Each of the second corrugated plates spans a gap between two of the hollow bricks that are spaced apart in the first direction and a gap between two of the first corrugated plates that are spaced apart in the second direction. Each of the second corrugated plates is supported by the inner holding ribs of two of the hollow bricks that are spaced apart in the first direction.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
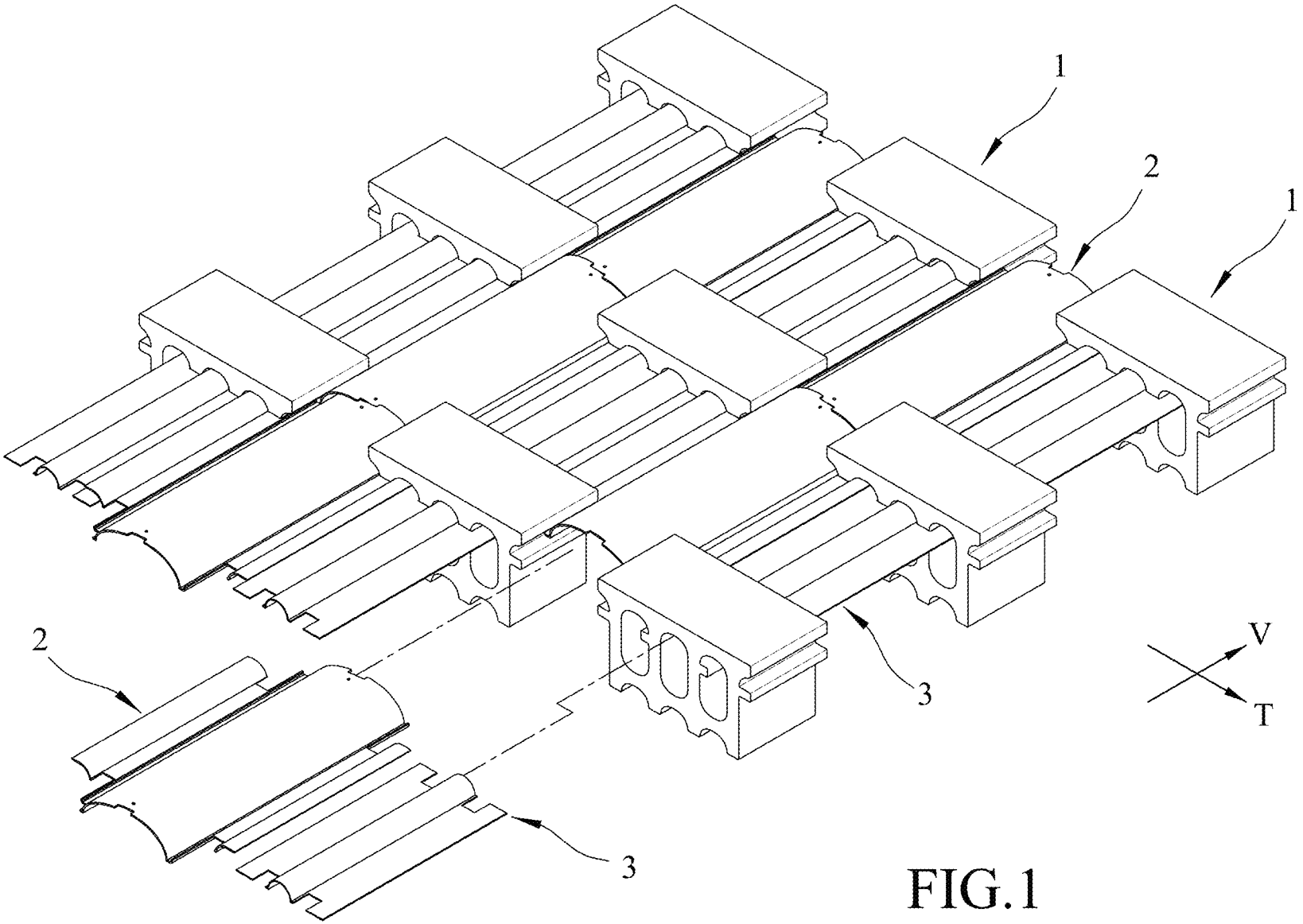
FIG. 1 is an exploded perspective view illustrating a first embodiment of a ventilating and heat dissipating assembly according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

FIG. 1 illustrates a first embodiment of a ventilating and heat dissipating assembly for a roof according to the disclosure. The ventilating and heat dissipating assembly includes a plurality of spaced apart hollow bricks 1, a plurality of first corrugated plates 2, and a plurality of second corrugated plates 3. Each of the first and second corrugated plates 2, 3 is made from a plastic material. The first and second corrugated plates 2, 3 are cheap and easily moldable, and have flexible and resilient properties so that they can be easily placed in an assembled state through their resilient returning forces.

Figure 2:
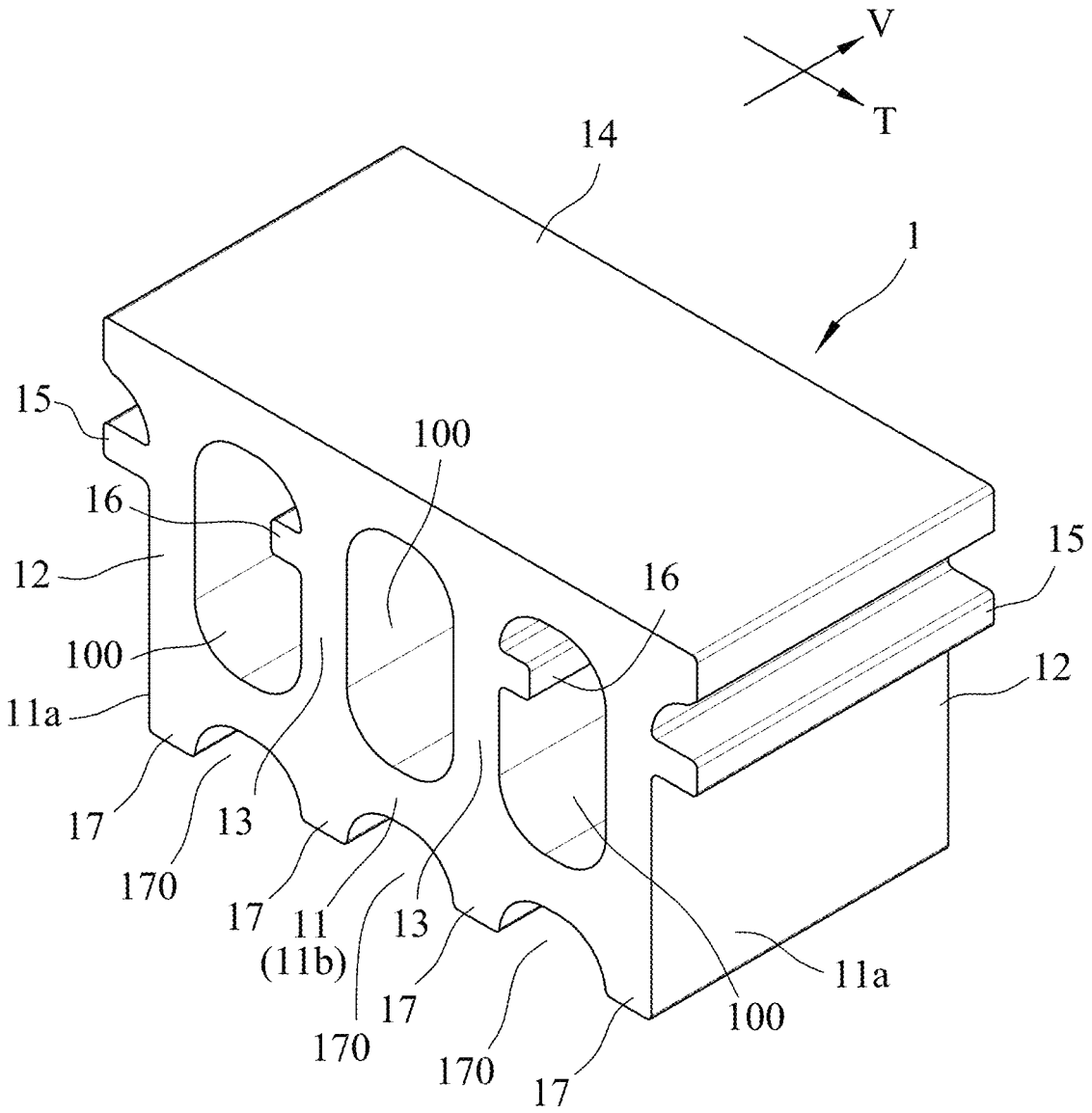
FIG. 2 is a perspective view illustrating a hollow brick of the first embodiment.

Referring FIGS. 1 and 2, the hollow bricks 1 are arranged in intersecting rows along a first direction (V) and a second direction (T) intersecting the first direction (V). Each hollow brick 1 is manufactured through cold pressing and casting processes. Each hollow brick 1 includes a bottom wall 11, two side walls 12, two intermediate walls 13, a top wall 14, three ventilation holes 100, two outer holding ribs 15, and two inner holding ribs 16. The bottom wall 11 has two opposite transverse sides 11*a* and two opposite longitudinal sides 11*b* connected between said transverse sides 11*a*. The side walls 12 respectively and upwardly project from the two opposite transverse sides 11*a* of the bottom wall 11. The intermediate walls 13 project upwardly from the bottom wall 11 between the side walls 12 and are spaced apart along a direction parallel with the longitudinal sides 11*b* of the bottom wall 11. The top wall 14 is opposite to the bottom wall 11 and disposed on top of the side walls 12 and the intermediate walls 13. The ventilation holes 100 are bounded by the bottom wall 11, the side walls 12, the intermediate walls 13 and the top wall 14. Each of the ventilation holes 100 has two ventilation open ends opposite to each other along a line parallel with the transverse sides 11*a* of the bottom wall 11. The holding ribs 15 project respectively from outer surfaces of the side walls 12 in opposite outward directions. The inner holding ribs 16 project respectively from the intermediate walls 13 in two opposite directions. In particular, each of the inner holding ribs 16 projects from one of the intermediate walls 13 into one of the ventilation holes 100. The bottom wall 11 of each hollow brick 1 has a plurality of foot portion 17 projecting downwardly and spaced apart from each other, and a plurality of bottom grooves 170 each of which is formed between two adjacent ones of the foot portions 17.

Figure 3:
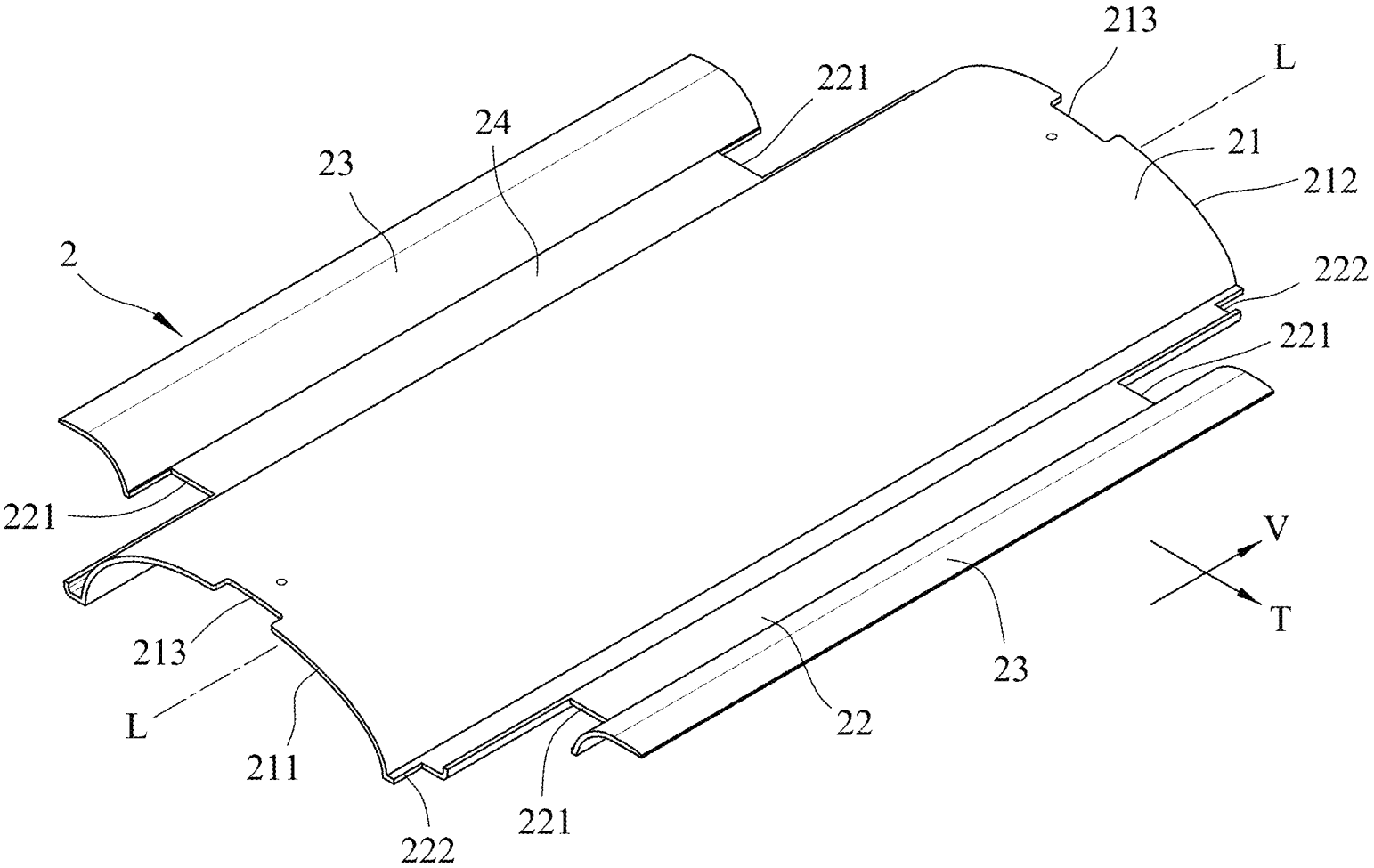
FIG. 3 is a perspective view illustrating a first corrugated plate of the first embodiment.
Figure 4:
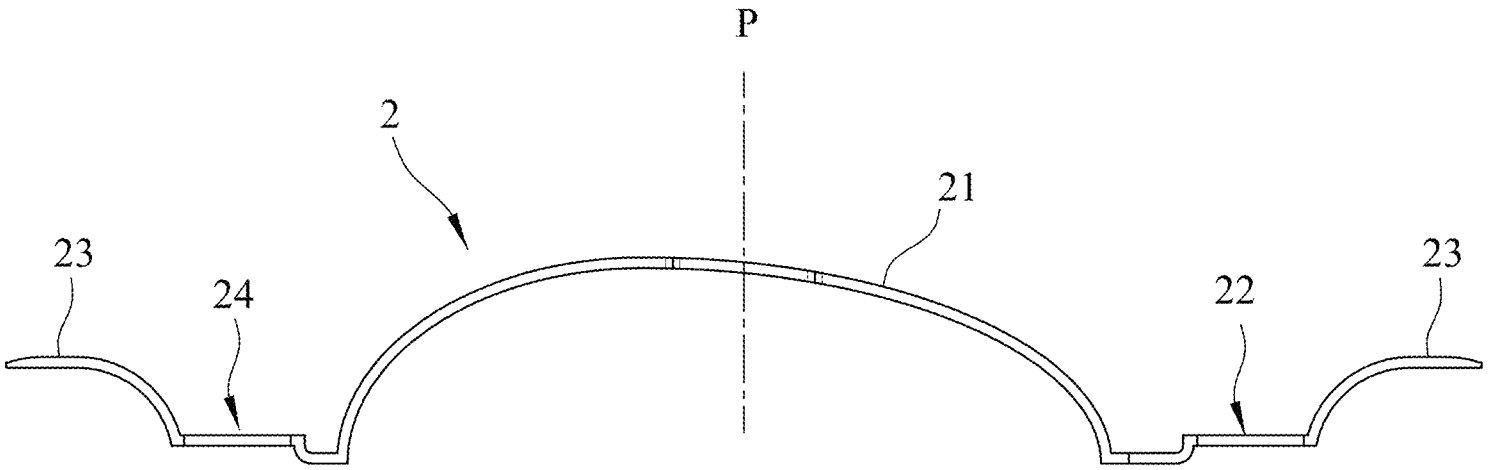
FIG. 4 is a front view of the first corrugated plate shown in FIG. 3.

Referring to FIGS. 3 and 4, in combination with FIGS. 1 and 2, the first corrugated plates 2 are connected to each other and aligned along the first direction (V). Each first corrugated plate 2 spans a gap between two pairs of the hollow bricks 1 that are spaced apart in the first and second directions (V, T). Further, each first corrugated plate 2 has a crest portion 21, a first trough portion 22, a second trough portion 24, and two curved rise portions 23. The crest portion 21 is elongated along and curved around a crest axial line (L) parallel with the first direction (V). The crest portion 21 has two opposite lateral sides on two opposite sides of the crest axial line (L). The crest portion 21 is an arcuate plate with a curvature that is asymmetric with respect to a central plane (P) which is parallel to the crest axial line (L) and which intersects the crest portion 21 at a middle of the crest portion 21. The crest portion 21 has a first arcuate end 211, a second arcuate end 212 opposite to the first arcuate end 211 in the first direction (V), and two indentations 213 respectively indented from the first and second arcuate ends 211, 212. The first trough portion 22 and the second trough portion 24 are respectively connected to the two opposite lateral sides of the crest portion 21. The first trough portion 22 is seated on one of the outer holding ribs 15 of one of two adjacent ones of the hollow bricks 1 that are spaced apart in the second direction (T). The second trough portion 24 is seated on one of the outer holding ribs 15 of the other one of the two hollow bricks 1 that are spaced apart in the second direction (T). Each of the first and second trough portions 22, 24 has two trough ends that are opposite along a line parallel to the axial line (L) of the crest portion 21 and two notches 221 which are indented inwardly and respectively from the two trough ends. Each of the notches 221 engages with one of the side walls 12 of one of the hollow bricks 1. The first trough portion 22 further has two cutouts 222 which are indented inwardly and respectively from the two trough ends of the first trough portion 22. The curved rise portions 23 are respectively connected to the first and second trough portions 22, 24 oppositely of the crest portion 21 and are curved in the same direction as the crest portion 21.

Figure 5:
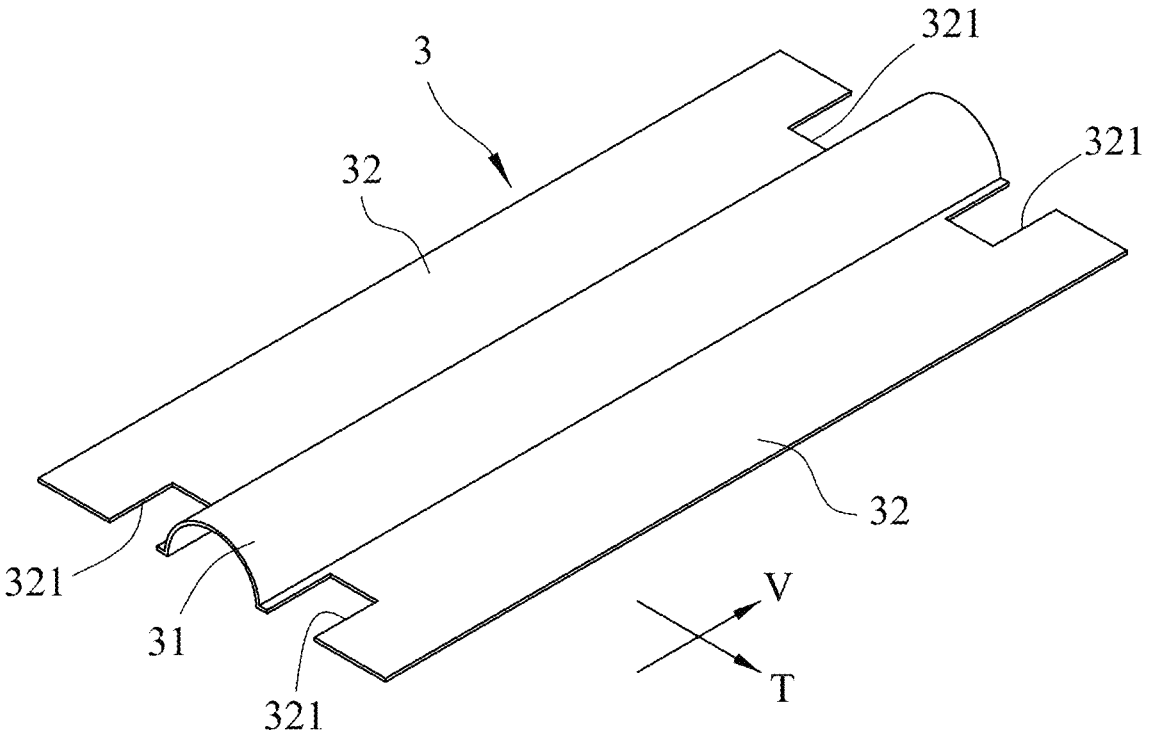
FIG. 5 is a perspective view illustrating a second corrugated plate of the first embodiment.

Referring to FIG. 5, in combination with FIGS. 1 and 2, each of the second corrugated plates 3 spans a gap between two hollow bricks 1 that are spaced apart in the first direction (V) and a gap between two first corrugated plates 2 that are spaced apart in the second direction (T). Each of the second corrugated plates 3 has a curved middle portion 31 elongated in the first direction (V), and two wing portions 32 respectively extending from two opposite sides of the curved middle portion 31 in opposite outward directions. The wing portions 32 are supported by the inner holding ribs 16 of two hollow bricks 1 that are spaced apart in the first direction (V). Each of the wing portions 32 has first and second wing ends that are opposite along the first direction (V), and two recesses 321 respectively recessed from the first and second wing ends. Each of the recesses 321 of the wing portions 32 engages with one of the intermediate walls 13 of two hollow bricks 1 that are spaced apart in the first direction (V).

Figure 6A:
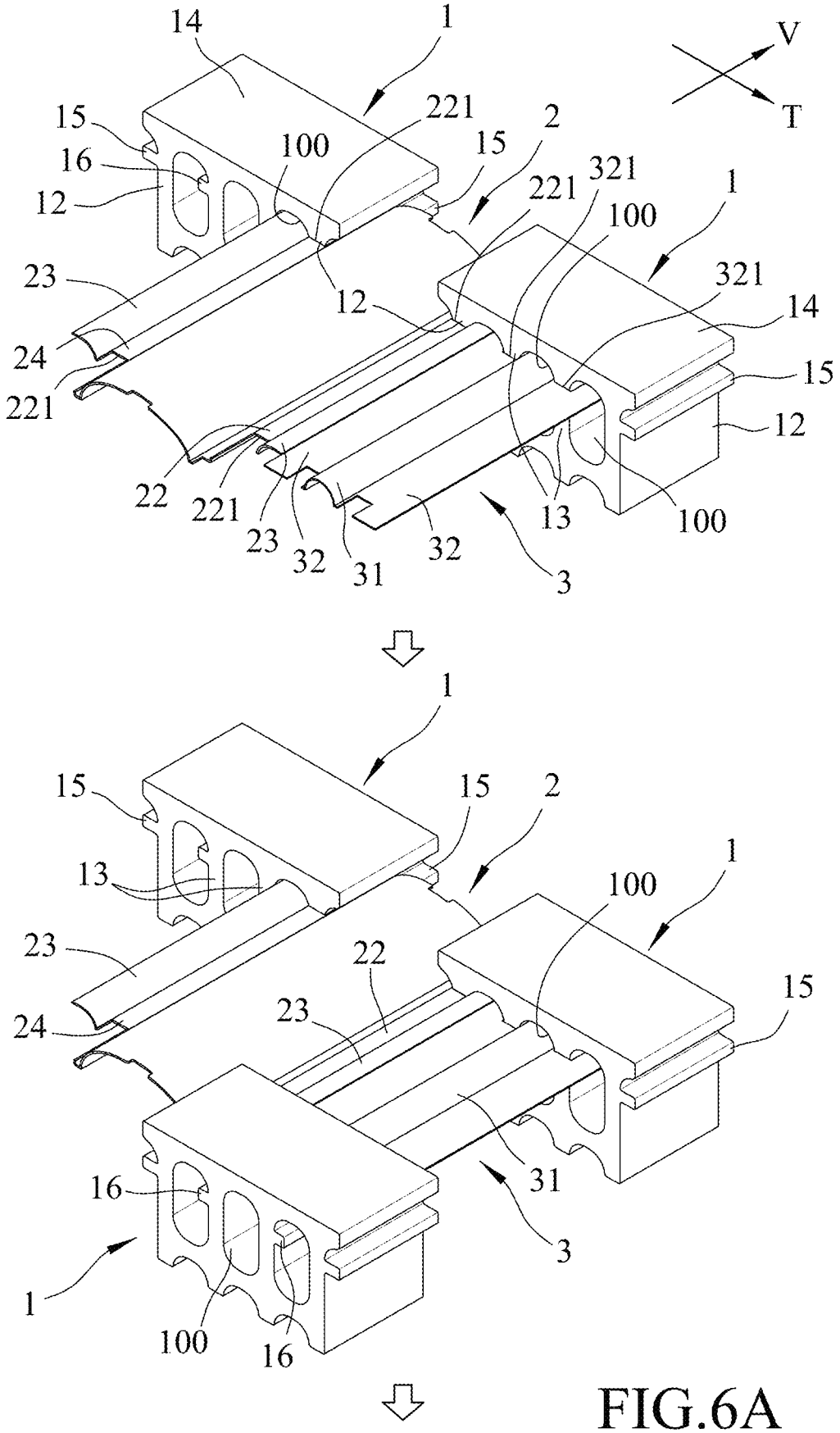
FIGS. 6A to 6C illustrate how the first embodiment of the ventilating and heat dissipating assembly are assembled.
Figure 6B:
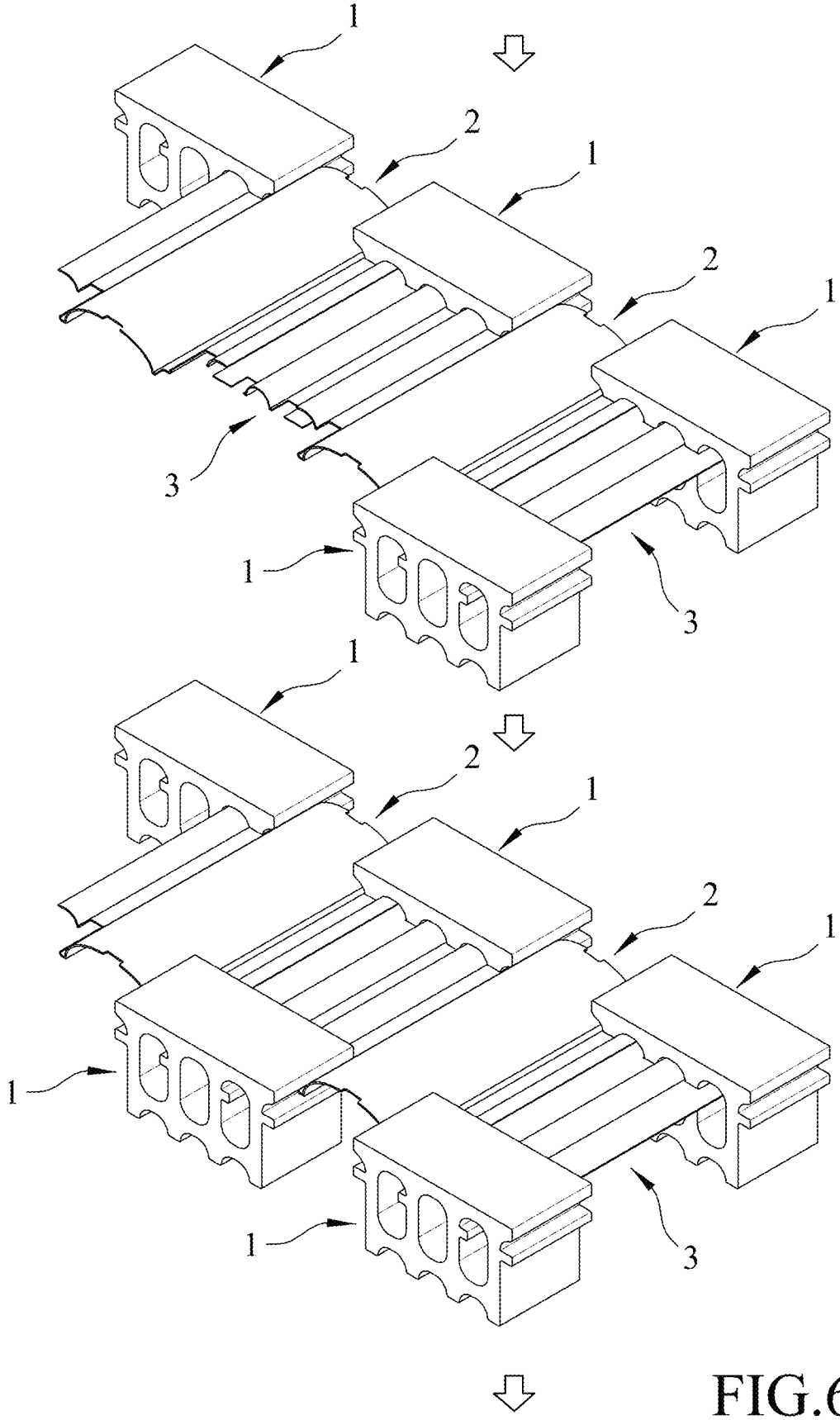
Figure 6C:
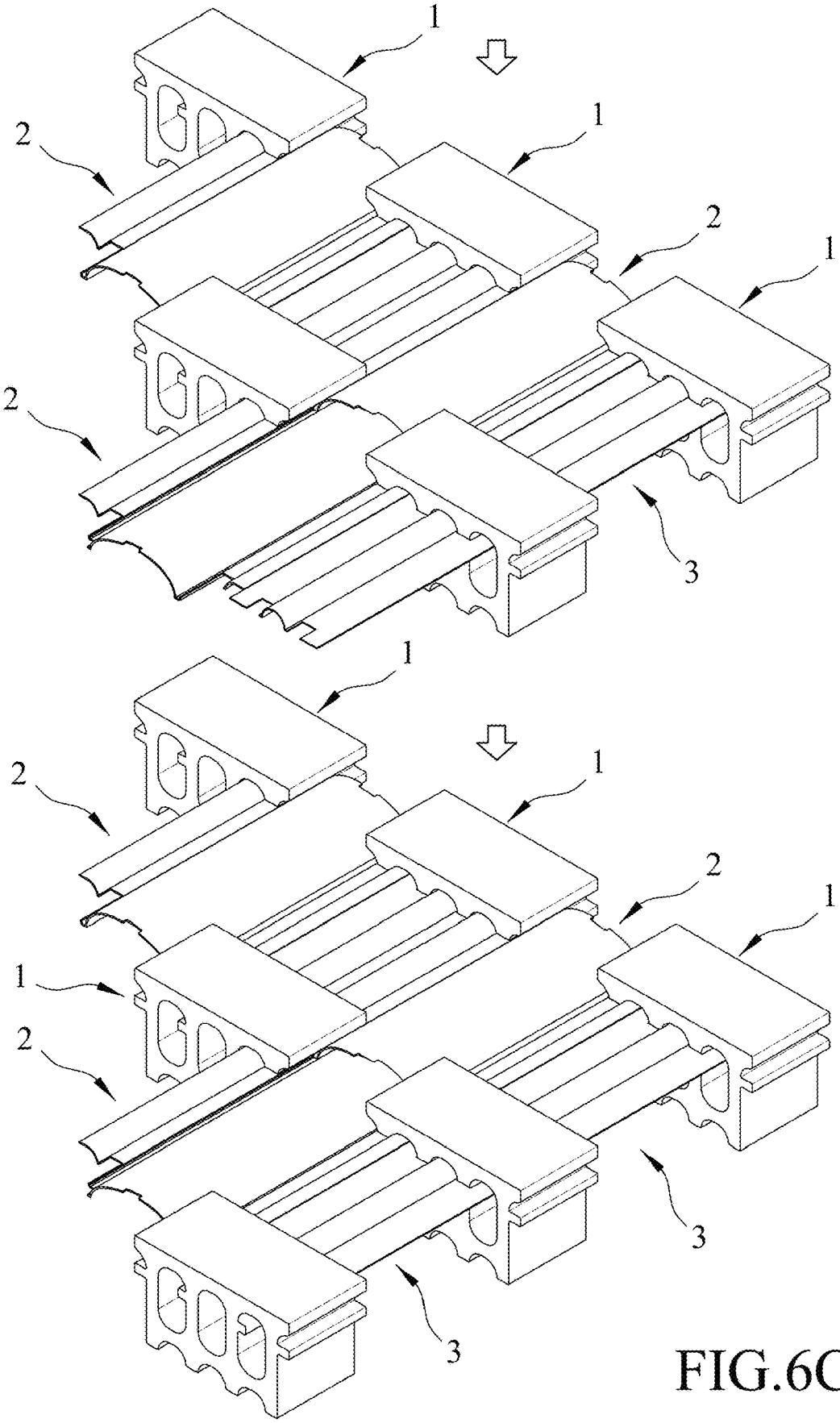

Referring to FIGS. 6A to 6C, in combination with FIG. 2, to install the ventilating and heat dissipating assembly, one of the second corrugated plates 3 is first assembled to one of two hollow bricks 1 arranged in a spaced-apart manner along the second direction (T). The curved middle portion 31 of the second corrugated plate 3 has one end inserted into a middle one of the ventilation holes 100 of the hollow bricks 1. The wing portions 32 have their ends supported by the inner holding ribs 16 of the hollow brick 1. The recesses 321 of the wing portions 32 respectively engage with the intermediate walls 13 of the hollow brick 1. After the second corrugated plate 3 and one of the two hollow bricks 1 are assembled to each other, one of the first corrugated plates 2 is placed between the two hollow bricks 1 and is seated on one of the outer holding ribs 15 of each of the two hollow bricks 1. At the same time, the notches 221 of the first corrugated plate 2 are respectively placed in engagement with the side walls 12 of the hollow bricks 1. The first corrugated plate 2 is therefore limited from moving in a top-bottom direction and a left-right direction. Simultaneously, the curved rise portions 23 of the first corrugated plate 2 are fixed with each of their ends being inserted into one of the ventilation holes 100 of one of the hollow bricks 1 and abutting inner surfaces of one of the side walls 12 and the top wall 14, which bound the ventilation hole 100. Because each first corrugated plate 2 is made from the plastic material, the first corrugated plates 2 are limited from moving in the top-bottom direction by a resilient returning force of the plastic material. After the first corrugated plate 2 is positioned to the hollow bricks 1, another end of the second corrugated plate 3 is inserted into another hollow brick 1 that is spaced apart from the previous hollow brick 1 in the first direction (V).

Figure 7:
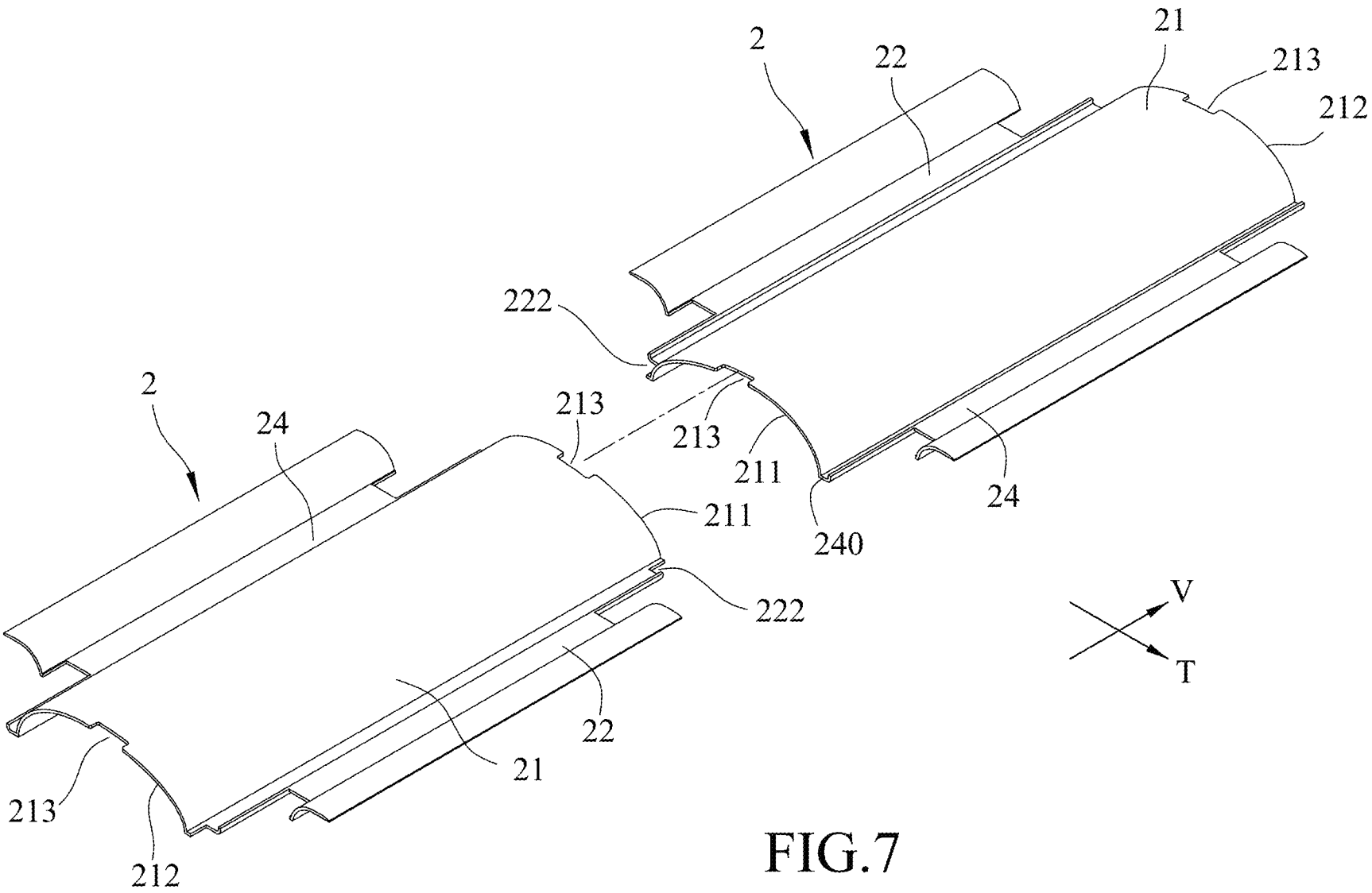
FIG. 7 is a perspective view of the first embodiment illustrating two first corrugated plates aligned with each other.
Figure 8:
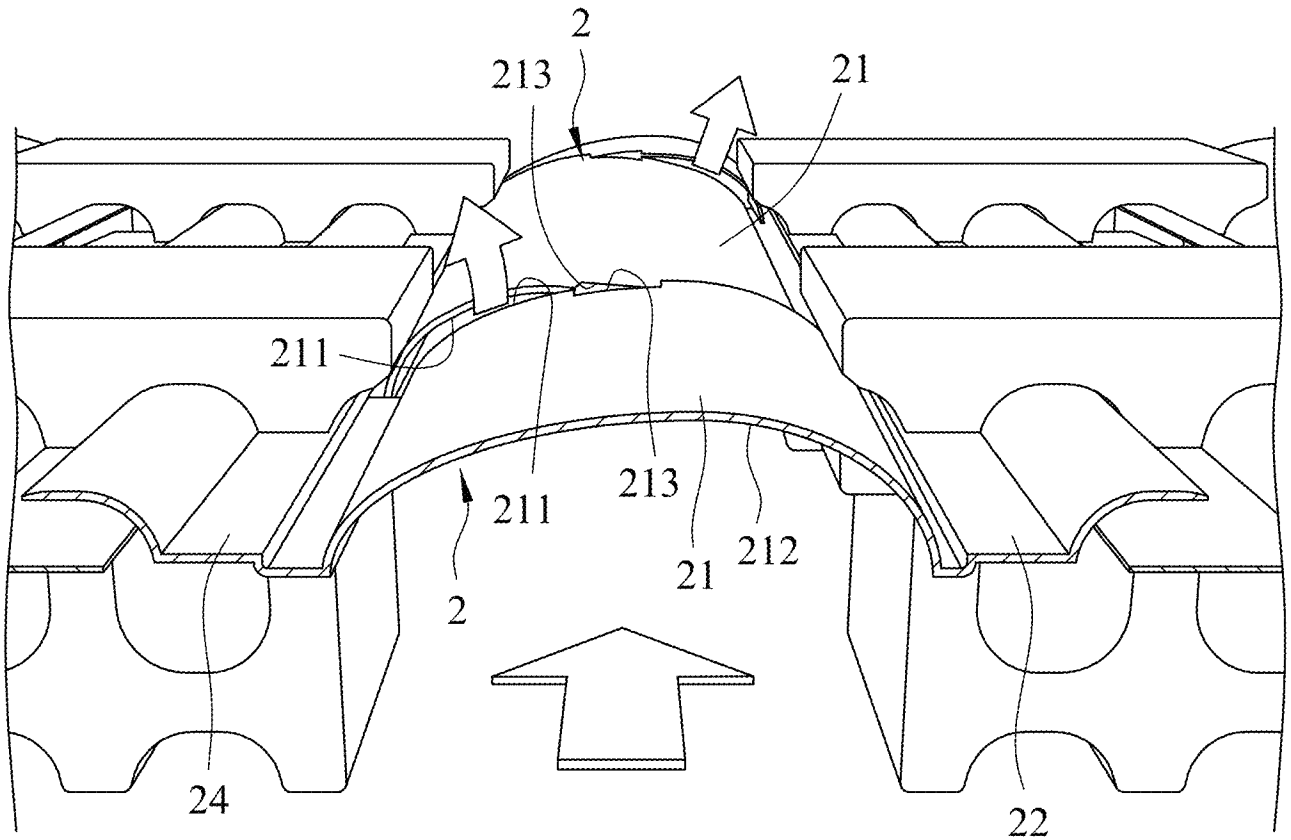
FIG. 8 is a fragmentary perspective view of the first embodiment illustrating ventilation paths formed by two first corrugated plates assembled with the hollow bricks.

Referring to FIGS. 7 and 8, to assemble two first corrugated plates 2 in the first direction (V), the first arcuate ends 211 of the first corrugated plates 2 are aligned and placed face to face each other in the first direction (V), and are interconnected with each other through inter-engagement of the indentations 213 of the first arcuate ends 211. At the same time, one of the cutouts 222 of the first trough portion 22 of each of the first corrugated plates 2 receives an overlapping part 240 of the second trough portion 24 of the other one of the first corrugated plates 2.

Figure 9:
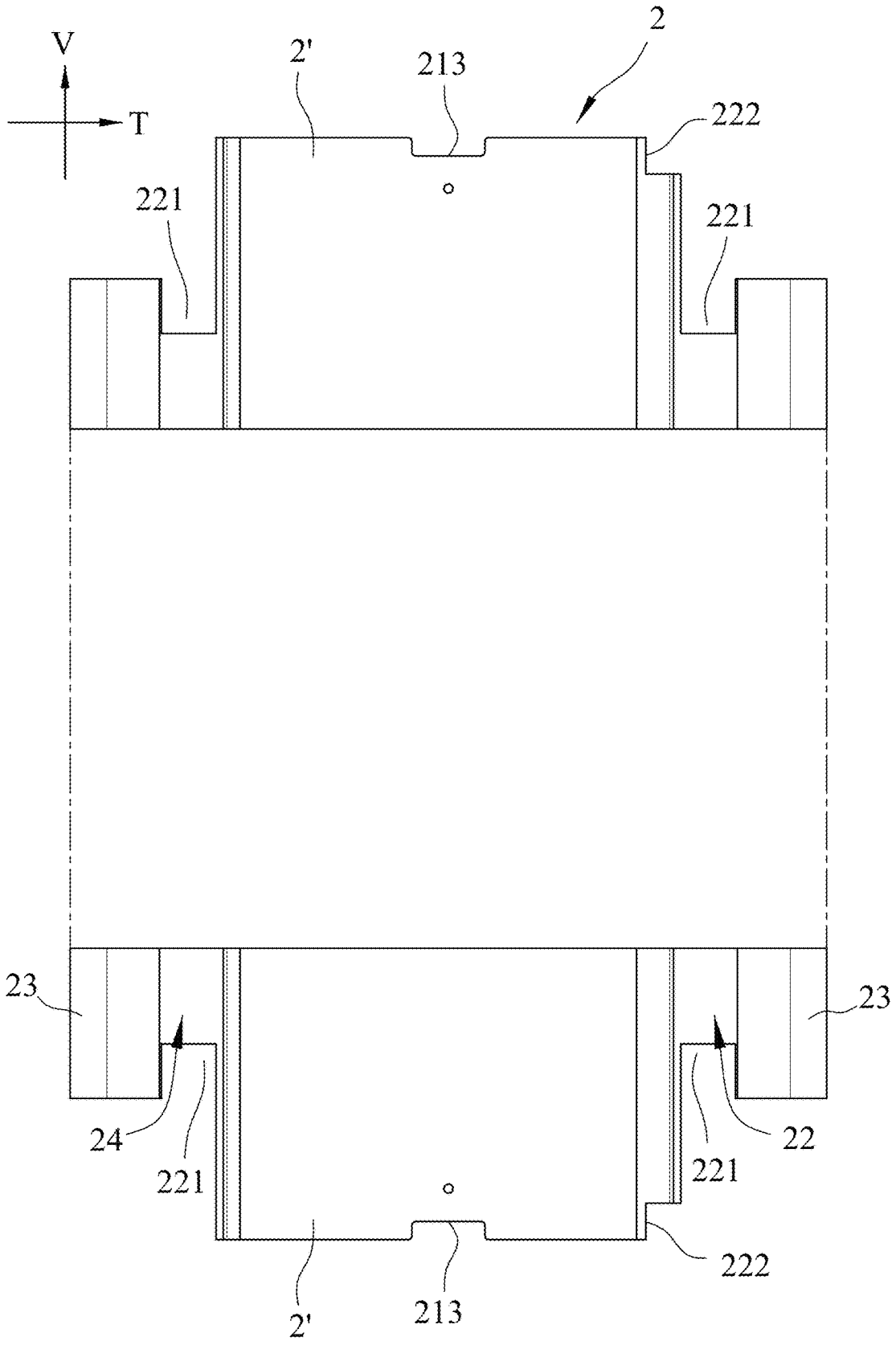
FIG. 9 is a top view of the first embodiment, illustrating a middle section of the first corrugated plate that is cut off from two end sections.
Figure 10:
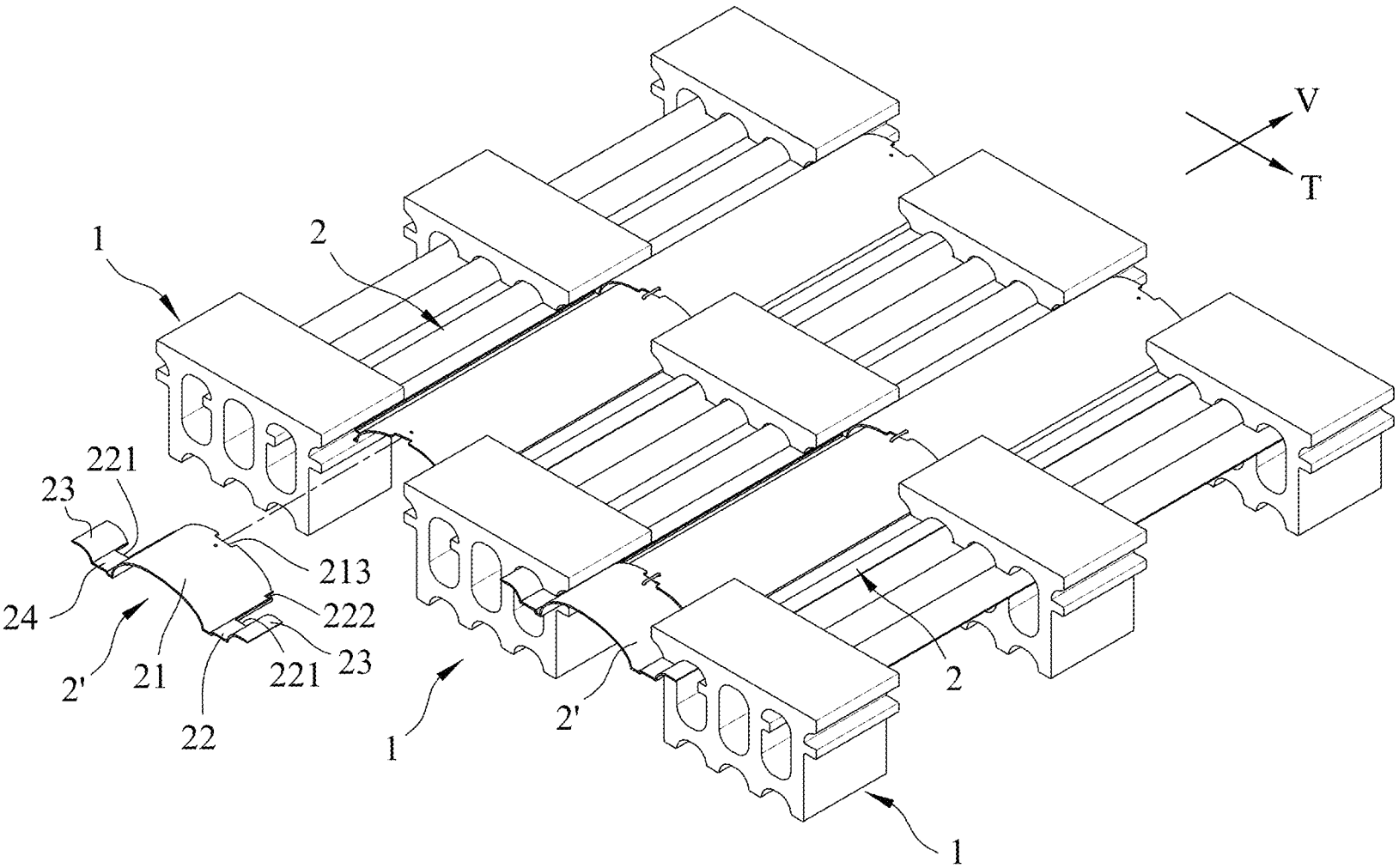
FIG. 10 is an exploded view of the first embodiment illustrating how the two end sections are used.

Reference is made to FIGS. 9 and 10. The first corrugated plate 2 is tailored by cutting off a middle section from two end sections 2' as shown in FIG. 9. Each end section 2' has the indentation 213, the notch 221 and the cutout 222 and thus is connectible to another first corrugated plate 2. As shown in FIG. 10, the first corrugated plates 2 are indented at lateral sides of a semi-finished assembly. The end sections 2' are provided with a size that fits the indent regions of the lateral sides. When the end sections 2' are connected to the first corrugated plates 2 as shown in FIG. 10, the indent regions are filled and the semi-finished assembly form a neat peripheral shape.

Referring back to FIGS. 6A to 6C, and 10, the first and second corrugated plates 2, 3 are shown to be assembled with the hollow bricks 1 arranged in intersecting rows along the first and second directions (V, T). The process of assembling the first and second corrugated plates 2, 3 and the hollow bricks 1 does not need any screw fastener or special tools. Masonry, piling and nailing processes are not necessary either. Without the need of changing an existing structure of a building, the ventilating and heat dissipating assembly of the first embodiment can be laid on a building roof in such a manner that the assembly is matched with the area of the building roof.

Figure 11:
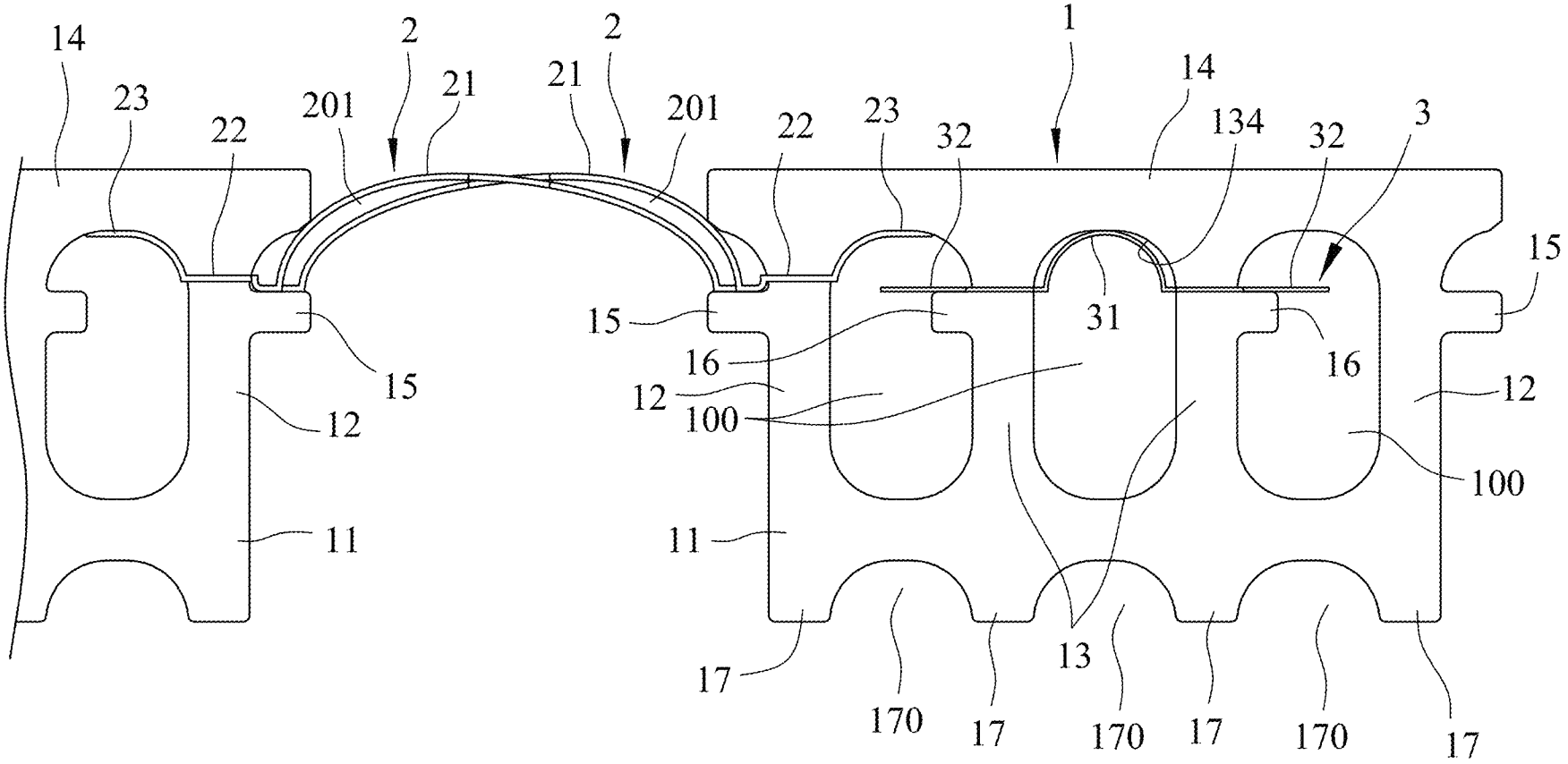
FIG. 11 is a fragmentary front view of the first embodiment.

Referring to FIG. 11, in combination with FIG. 10, the first corrugated plates 2 are interconnected and aligned in the first direction (V). Because the curvature of each crest portion 21 is asymmetric with respect to the central plane (P) (see FIG. 4), when each crest portion 21 is viewed from the first and second arcuate ends 211, 212, it presents two different shapes that form a mirror image of each other. Therefore, when two first corrugated plates 2 are aligned and when one of the first corrugated plates 2 is reversed to place the first arcuate end 211 thereof face to face with the first arcuate end 211 of the other first corrugated plate 2, the crest portions 21 of the two first corrugated plates 2 are staggered and ventilation gaps 201 are formed between the first arcuate ends 211 of the crest portions 21 to allow ventilation in the first direction (V). Further, the ventilation holes 100 and the bottom grooves 170 of each hollow brick 1 provide additional ventilation paths along the first direction (V). As shown in FIG. 10, each of the hollow bricks 1 has an upper curved boundary surface 134 defined by the top wall 14 and the intermediate walls 13 and bounding an upper side of one of the ventilation holes 100. The curved middle portion 31 of each of the second corrugated plates 3 inserted into the ventilation hole 100 abuts part of the upper curved boundary surface 134 in such a manner that a gap is formed between the curved middle portion 31 and the upper curved boundary surface 134 for ventilation. By virtue of the foot portions 17 and the bottom grooves 170, water accumulation between the bottom wall 11 and the roof surface may be reduced or even eliminated.

Figure 12:
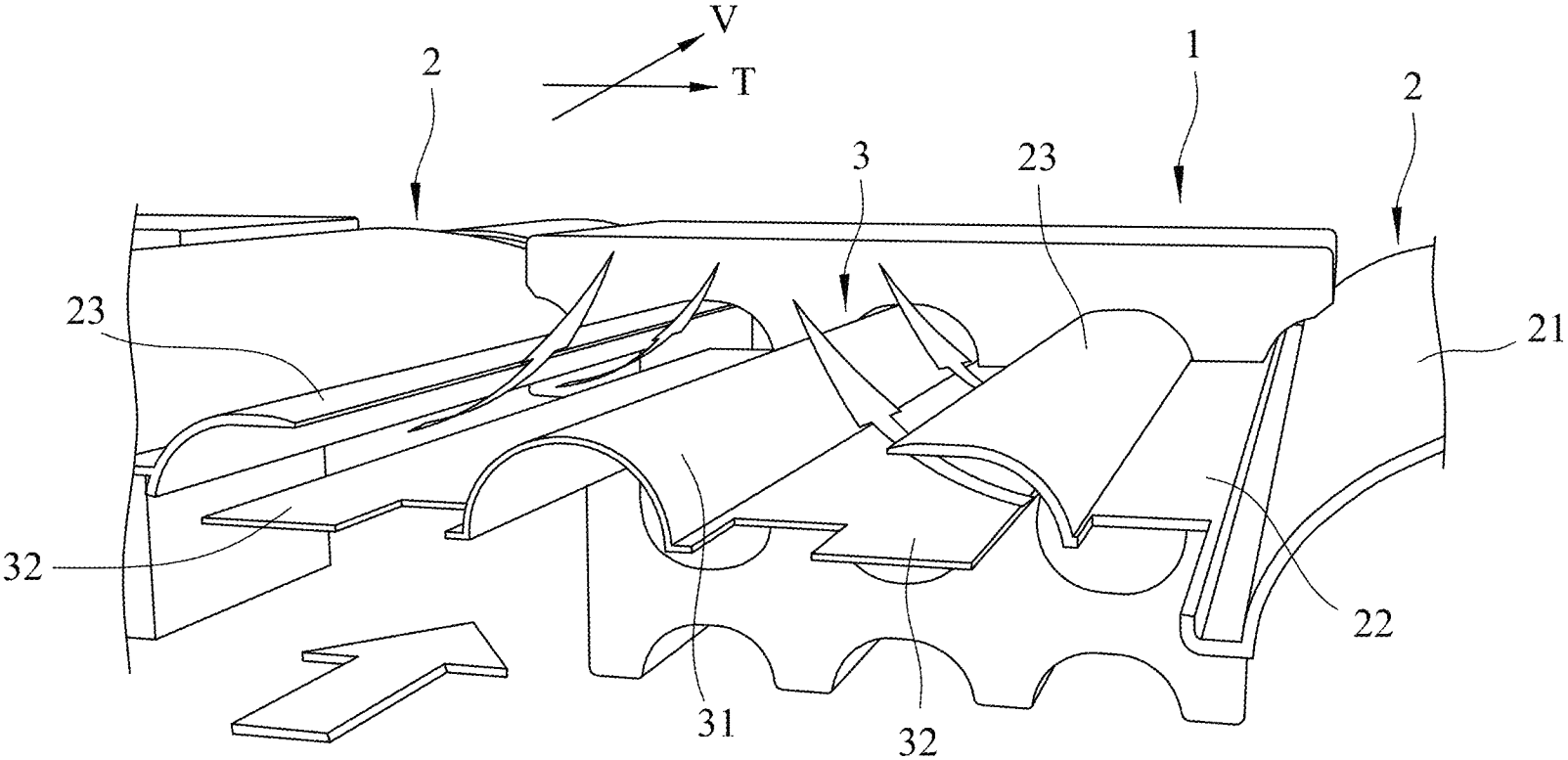
FIG. 12 is an exploded perspective view of the first embodiment illustrating air flow paths formed between the first corrugated plates and the second corrugated plates.
Figure 13:
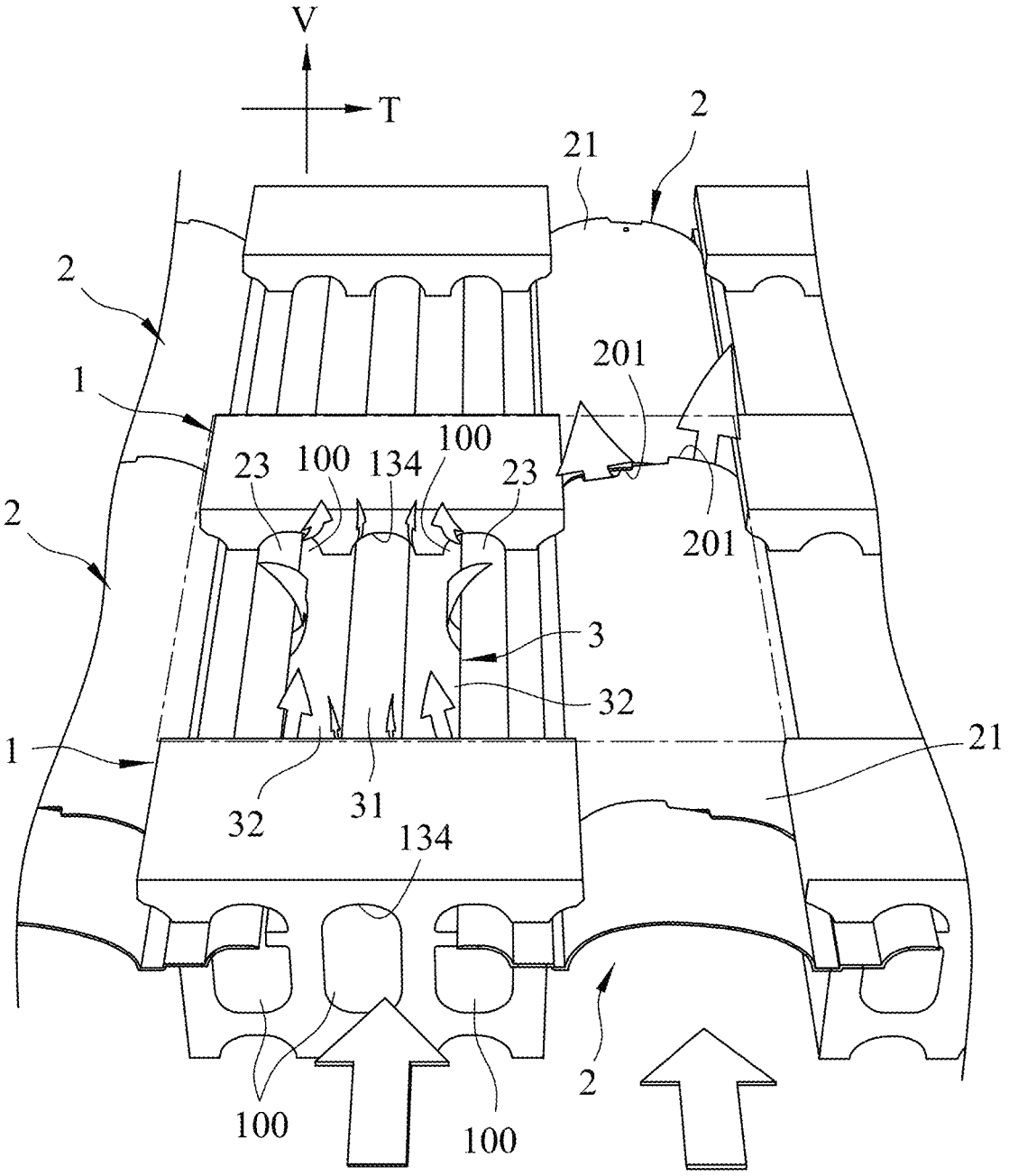
FIG. 13 is an exploded perspective view of the first embodiment illustrating air flow paths formed by the first corrugated plates, the second corrugated plates and the hollow bricks.

Referring to FIGS. 12 and 13, there is a height difference between each curved rise portion 23 of the first corrugated plates 2 and one of the wing portions 32 of an adjacent one of the second plates 3. The height difference provides an air flow path along the second direction (T). In FIG. 13, as shown by arrows within a region encircled by phantom lines, the region has two air flow paths 201 formed between two first corrugated plates 2, six air flow paths formed between the curved middle portions 31 of the second corrugated plates 3 and the upper boundary surfaces 134 of the hollow bricks 1, and two air flow paths formed between the curved rise portions 23 of the first corrugated plates 2 and the wing portions 32 of the second corrugated plates 3. The mere region has a total of ten air flow paths on the top of the building roof in this embodiment. Therefore, the ventilation and heat dissipating assembly of the first embodiment is a thoroughly ventilatable structure which is highly efficient to ventilate and dissipate heat. In use, the ventilation and heat dissipating assembly can prevent sunlight from directly irradiating the surface of the building. In summer, the surface of the building directly irradiated by the sunlight can have a temperature of almost 60° C. When the ventilation and heat dissipating assembly of the embodiment is used, the temperature of the building roof surface can be reduced by an amount ranging from 17° C. to 21° C. Therefore, the indoor temperature of the building can be reduced to mitigate operation loads of an air conditioner. For long term use, electric power and maintenance costs can be saved.

Figure 14:
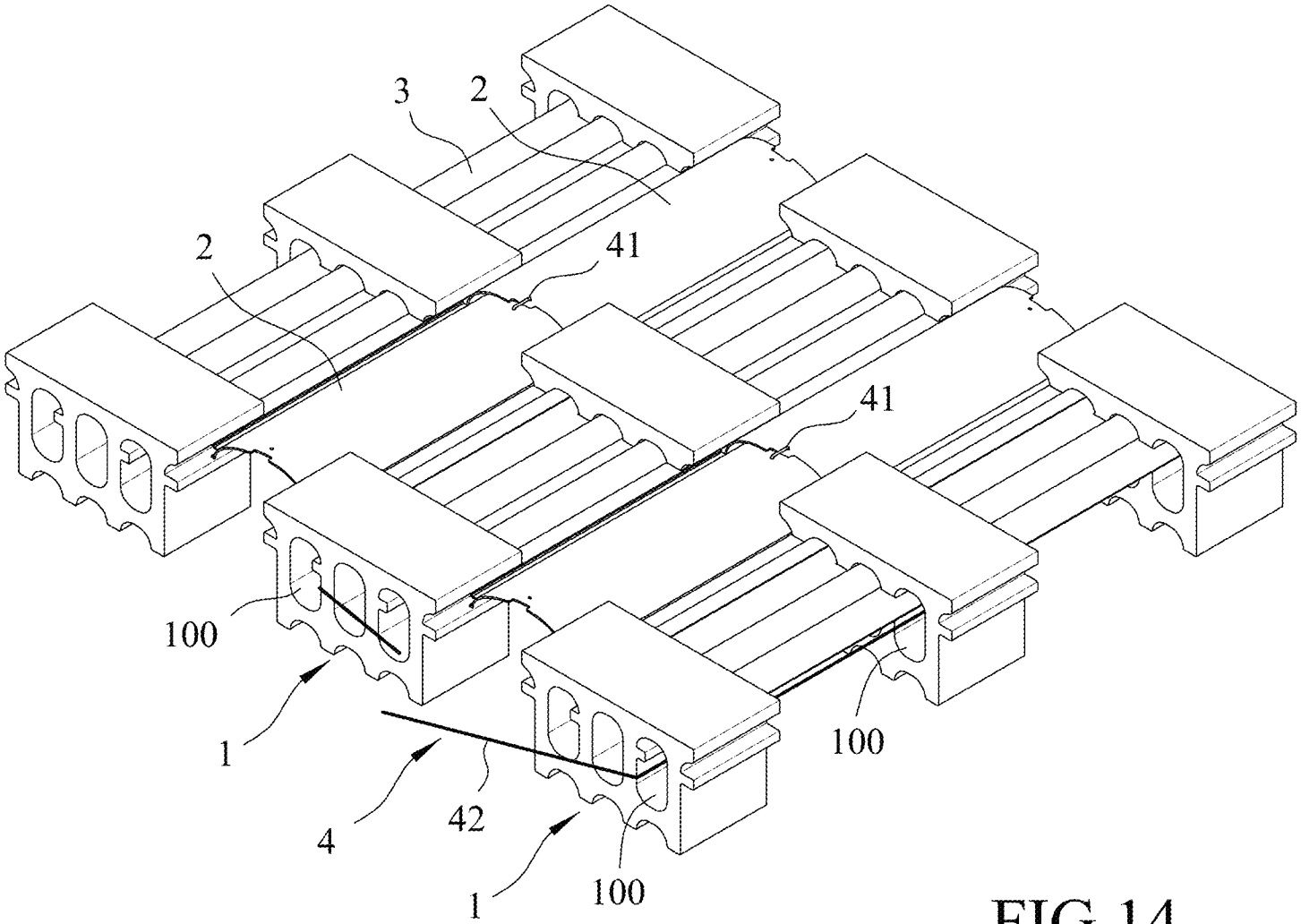
FIG. 14 is a perspective view illustrating a second embodiment of a ventilating and heat dissipating assembly.
Figure 15:
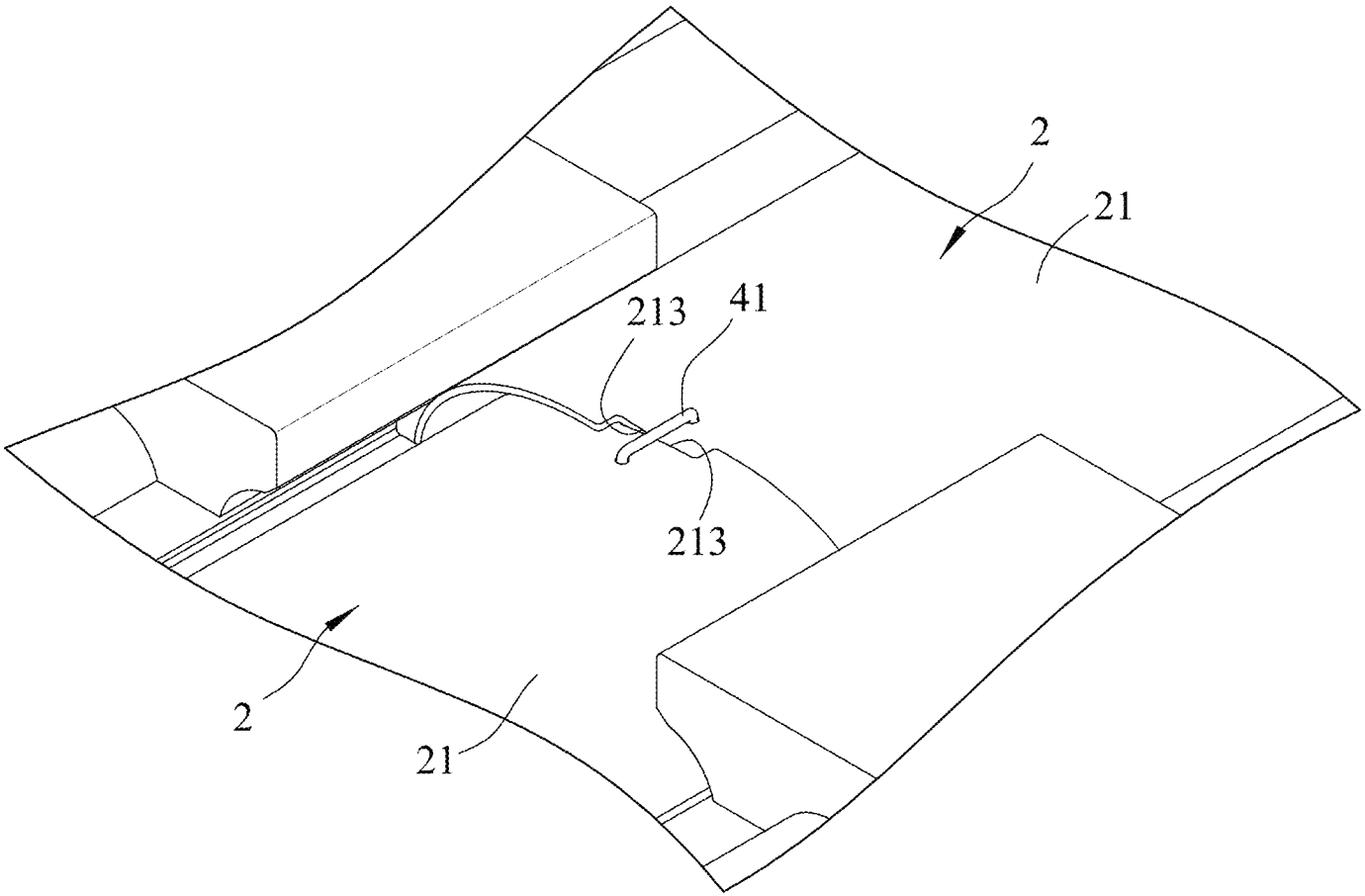
FIG. 15 is a fragmentary perspective view of the second embodiment illustrating how a staple is used in the ventilating and heat dissipating assembly.

FIGS. 14 and 15 illustrate a second embodiment of a ventilating and heat dissipating assembly according to the disclosure, which has a structure generally similar to that of the first embodiment. However, in this embodiment, the ventilating and heat dissipating assembly further includes an auxiliary unit 4. The auxiliary unit 4 includes a plurality of staples 41 each of which fastens together two of the first corrugated plates 2, and steel wire ropes 42 extending through the ventilation holes 100 of the hollow bricks 1 for positioning the same.

To strengthen linking of the first and second corrugated plates 2, 3 and the hollow bricks 1, each staple 41 is used to fasten together two first corrugated plates 2 at the joint where the indentations 213 of the first arcuate ends 212 are inter-engaged. The steel wire rope 42, if necessary, is used to bind together the hollow bricks 1 located at the peripheral region of the assembly of the embodiment. The strength to join and stabilize the hollow bricks 1 can thus be increased.

Figure 16:
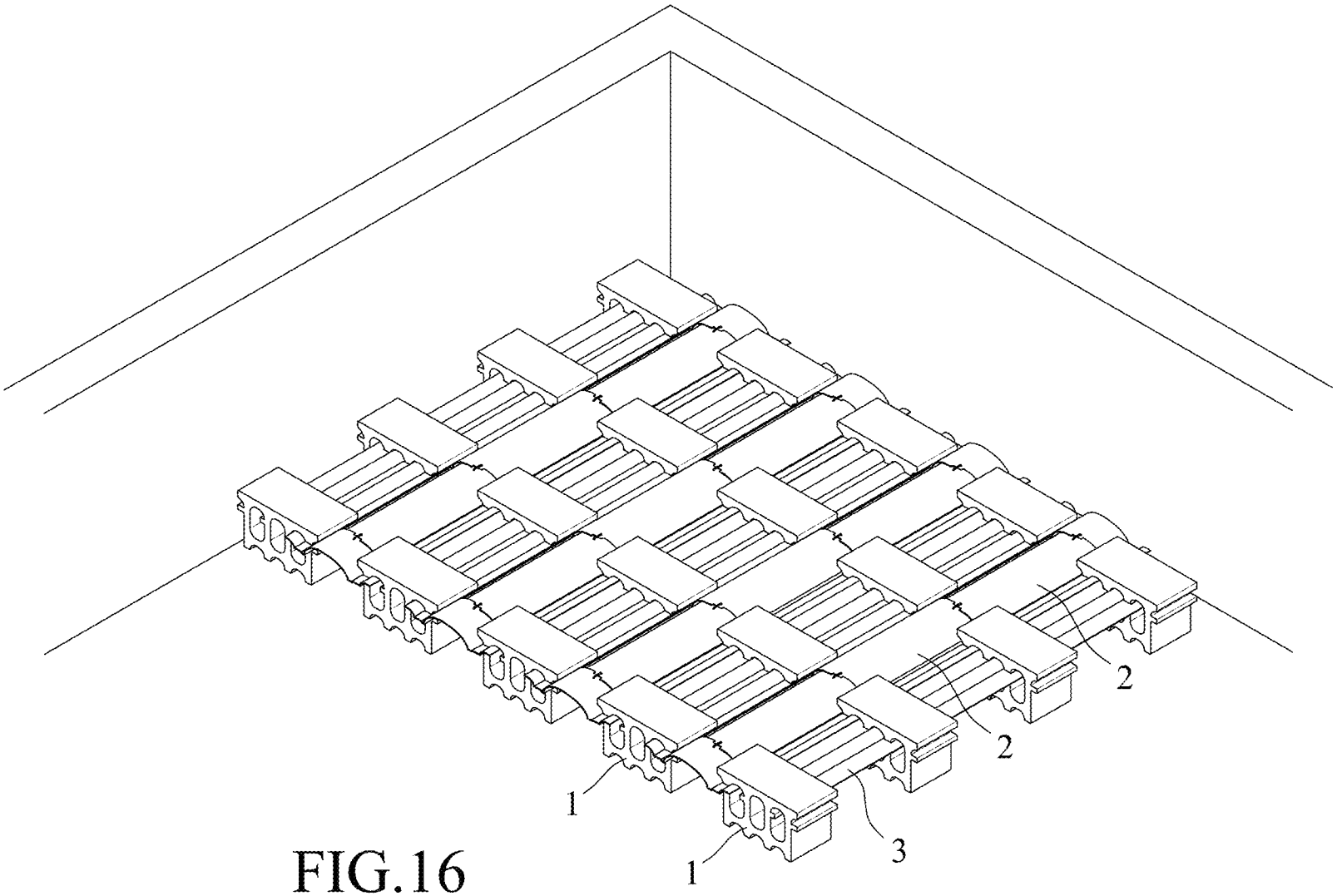
FIG. 16 is a perspective view of the second embodiment illustrating the ventilating and heat dissipating assembly installed on a roof surface.

Referring to FIG. 16, aside from ventilation, heat-dissipation and heat-insulation effects, the ventilating and heat dissipating assembly can be an escape platform. To be the escape platform, the hollow bricks 1 may be spaced apart from each other at intervals ranging between 55 centimeters and 60 centimeters, preferably 58.5 centimeters, which is a walking distance of a normal person. By virtue of the auxiliary unit 4 securing together the first and second corrugated plates 2, 3 and the hollow bricks 1, the hollow bricks 1 are stable, and the ventilating and heat dissipating assembly can serves as the escape platform to allow people to step thereon for escaping.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A ventilating and heat dissipating assembly for a roof, comprising:

a plurality of spaced apart hollow bricks arranged in intersecting rows that extend along a first direction and a second direction intersecting the first direction, each of said hollow bricks includes a bottom wall having two opposite transverse sides and two opposite longitudinal sides connected between said transverse sides, two side walls respectively and upwardly projecting from said two opposite transverse sides of said bottom wall, a plurality of intermediate walls projecting upwardly from said bottom wall between said side walls and spaced apart along a direction parallel with said longitudinal sides of said bottom wall, a top wall opposite to said bottom wall and disposed on top of said side walls and said intermediate walls, a plurality of ventilation holes bounded by said bottom wall, said side walls, said intermediate walls and said top wall, each of said ventilation holes having two ventilation open ends opposite to each other along a line parallel with said transverse sides of said bottom wall, two outer holding ribs projecting respectively from outer surfaces of said side walls in opposite outward directions, and a plurality of inner holding ribs each of which projects from one of said intermediate walls into one of said ventilation holes;

a plurality of first corrugated plates which are connected to each other and aligned along the first direction and each of which spans a gap formed between two pairs of said hollow bricks that are spaced apart in the first and second directions, each of said first corrugated plates having a crest portion elongated along and curved around a crest axial line parallel with the first direction, said crest portion having two opposite lateral sides on two opposite sides of said crest axial line, a first trough portion connected to one of said two opposite lateral sides of said crest portion, said first trough portion being seated on one of said outer holding ribs of one of two adjacent ones of said hollow bricks that are spaced apart in the second direction, a second trough portion connected to the other one of said two opposite lateral sides of said crest portion, said second trough portion being seated on one of said outer holding ribs of the other one of said two adjacent ones of said hollow bricks that are spaced apart in the second direction, and two curved rise portions respectively connected to said first and second trough portions oppositely of said crest portion and being curved in the same direction as said crest portion; and a plurality of second corrugated plates, each of which spans a gap between two of said hollow bricks that are spaced apart in the first direction and a gap between two of said first corrugated plates that are spaced apart in the second direction, each of said second corrugated plates being supported by said inner holding ribs of said two of said hollow bricks that are spaced apart in the first direction.

2. The ventilating and heat dissipating assembly as claimed in claim 1, wherein said bottom wall of each of said hollow bricks has a plurality of foot portion projecting downwardly and spaced apart from each other, and a plurality of bottom grooves each of which is formed between two adjacent ones of said foot portions.

3. The ventilating and heat dissipating assembly as claimed in claim 1, said crest portion of each of said first corrugated plates is an arcuate plate with a curvature that is asymmetric with respect to a central plane which is parallel to said crest axial line and that intersects said arcuate plate at a middle of said arcuate plate.

4. The ventilating and heat dissipating assembly as claimed in claim 1, wherein:

said crest portion of each of said first corrugated plates further has a first arcuate end, a second arcuate end opposite to said first arcuate end in the first direction, and two indentations respectively indented from said first and second arcuate ends; and said first arcuate ends of two adjacent ones of said first corrugated plates are aligned and placed face to face each other in the first direction, and are interconnected with each other through inter-engagement of said indentations of said first arcuate ends.

5. The ventilating and heat dissipating assembly as claimed in claim 1, wherein, for each of said first corrugated plates, each of said first and second trough portions has two trough ends that are opposite along a line parallel to the axial line of said crest portion, and two notches which are indented inwardly and respectively from said two trough ends, each of said notches engaging with one of said side walls of one of said hollow bricks.

6. The ventilating and heat dissipating assembly as claimed in claim 1, wherein, for each of said first corrugated plates, said first trough portion has two trough ends that are opposite along a line parallel to the axial line of said crest portion, and two cutouts which are indented inwardly and respectively from said two trough ends of said first trough portion, one of said cutouts of said first trough portion of each of said first corrugated plates receiving an overlapping part of said second trough portion of the other one of said first corrugated plates.

7. The ventilating and heat dissipating assembly as claimed in claim 1, wherein, each of said curved rise portions of each of said first corrugated plates has an end inserted into one of said ventilation holes of one of said hollow bricks and abuts inner surfaces of one of said side walls and said top wall, which bound said one of said ventilation holes.

8. The ventilating and heat dissipating assembly as claimed in claim 1, for each of said hollow bricks, the number of said intermediate walls is two, the number of said inner holding ribs is two, and the number of said ventilation holes is three, said inner holding ribs projecting respectively from said intermediate walls in two opposite directions.

9. The ventilating and heat dissipating assembly as claimed in claim 8, wherein each of said second corrugated plates has a curved middle portion elongated in the first direction, and two wing portions respectively extending from two opposite sides of said curved middle portion in opposite outward directions, said wing portions being supported by said inner holding ribs of two of said hollow bricks that are spaced apart in the first direction, each of said wing portions having first and second wing ends that are opposite along the first direction, and two recesses respectively recessed from said first and second wing ends, each of said recesses of said wing portions engaging with one of said intermediate walls of said two of said hollow bricks that are spaced apart in the first direction.

10. The ventilating and heat dissipating assembly as claimed in claim 9, wherein each of said hollow bricks has one of said ventilation holes formed between said intermediate walls and between said top and bottom walls, and an upper curved boundary surface defined by said top wall and said intermediate walls and bounding an upper side of said one of said ventilation holes, said curved middle portion of each of said second corrugated plates being inserted into said one of said ventilation holes and abutting part of said upper curved boundary surface in such a manner that a gap is formed between said curved middle portion and said upper curved boundary surface for ventilation.

* * * * *